US005857607A

United States Patent [19]

Reinders

[11] Patent Number: 5,857,607

[45] Date of Patent: Jan. 12, 1999

[54] FEED SYSTEM FOR TEXTILE GOODS

[75] Inventor: Peter Reinders, Ochtrup, Germany

[73] Assignee: Carl Schmale GmbH & Co., Ochtrup, Germany

[21] Appl. No.: 874,371

[22] Filed: Jun. 19, 1997

[30] Foreign Application Priority Data

Nov. 21, 1996 [DE] Germany ..... 296 20 232 U

[51] Int. Cl.[6] ..... B65H 20/00

[52] U.S. Cl. ..... 226/171

[58] Field of Search ..... 34/95, 631, 635, 34/637, 645; 198/831, 845; 100/76, 88, 222; 226/74, 170, 171, 176

[56] References Cited

U.S. PATENT DOCUMENTS

| | | | |
|---|---|---|---|
| 4,480,978 | 11/1984 | Gerhardt | 425/371 |
| 5,141,098 | 8/1992 | Schmale | 198/468.6 |
| 5,208,970 | 5/1993 | Ichikawa | 29/768 |
| 5,340,008 | 8/1994 | Freermann et al. | 226/171 |
| 5,561,918 | 10/1996 | Marschke | 34/629 |

FOREIGN PATENT DOCUMENTS 0 517 746 12/1992 European Pat. Off. .

*Primary Examiner*—Henry Bennett
*Assistant Examiner*—Steve Gravini
*Attorney, Agent, or Firm*—Herbert Dubno

[57] ABSTRACT

Via a textile guide system for flat textile goods, the textile goods are fed by a continuous conveyor to processing stations and the textile web is fed between conveyor elements of the continuous conveyor and a stationary support whereby means is provided to press the textile web against the stationary support and whereby each pressing member has a vertical guide means in which a housing-fixed holding pin engages and apart from the guide means at least one pressing spring means is provided whereby the noise formation is largely suppressed. The vertical guide means is close to the oncoming end of the pressing member approached by the conveyor and the pressing spring means is arranged close to the downstream end of the pressing means.

14 Claims, 3 Drawing Sheets

FEED SYSTEM FOR TEXTILE GOODS

FIELD OF THE INVENTION

The present invention relates to a feed system for flat articles, textile webs or textile goods, such as piece goods, fabric articles and the like, especially for automatic cutting and sewing apparatus capable of operating on such goods or for use with other types of textile processing machines and equipment.

BACKGROUND OF THE INVENTION

It is known to provide a system for feeding textile goods, in the form of a web or as individual pieces, preferably engaged at their edges by a continuous driving element, for example, a driving belt or chain, to processing stations which can be stations for folding, seaming, edge stabilization or the like. In general, the web or succession of fabric pieces are engaged between the continuously driven elements, for example, an endless belt or endless chain, and a stationary support which can be a fixed surface, a stationary rail or an array of fixedly located but freely rotatable rollers.

In such a system, means can be provided for pressing the textile goods against a stationary support such as the aforementioned rollers, the rail or surface, e.g. by pressing the conveyor element against a flat side of the article to be displayed. The resiliently mounted pressing elements may be spaced apart in the direction of travel and, in a system as described in EP 05 17 746 B1, each pressing member can be guided transversely to the travel direction by a vertical guide which likewise is perpendicular to the plane of the goods. This vertical guide can be a slot formed in the pressing member and receiving a pin which is fixed so that the pressing member can be biased by a pressing spring means against the conveying element and the goods engaged between the conveying element and the support surface or members. The pin and slit or slot can define the maximum displacement of the pressing member. The spring can be braced against a stationary bar or other portion of the housing which is oriented on a side of the pressing member opposite that along which the conveying element is provided. At the upstream side of the pressing member, with respect to the direction of displacement, i.e. the oncoming side for the textile goods, the pressing member is formed with an inclined edge guiding the conveyor element beneath the pressing member.

While this prior art apparatus has been satisfactory by and large in operation, the pressing members in use tend to generate excessive noise which is undesirable. Such noise results when a leading edge of a textile article clamped between the toothed belt and the underlying support passes into the region of a pressing member.

OBJECTS OF THE INVENTION

It is the principal object of the present invention to provide an improved feed system for textile articles whereby noise generation by the pressing members is largely suppressed.

Another object of the invention is to provide a feed system for textile articles such as textile webs and individual pieces which are free from the drawbacks of the prior art apparatus described previously.

SUMMARY OF THE INVENTION

According to the invention, the vertical guide means, i.e. the slit receiving the holding pin, is offset closer to the upstream side of the pressing member, i.e. the side at which the conveyor means, especially a belt, approaches the pressing member, while the spring means is offset on the pressing member to a location close to the rear or downstream end of the pressing member.

Since the slit for the holding pin is no longer located centrally with respect to the pressing member but rather is offset toward the upstream side, the noise which has been generated by the pressing member as a result of the flapping tendency thereof is suppressed, especially where the spring is provided close to the downstream end of the pressing member. In many cases, the suppression of the flapping action is so effective that there is no noise generated at the pressing member.

Preferably the pressing spring means, especially a pressing spring, is a coil spring of the compression type which is received in a blind bore of the pressing member, one end of the spring being engaged in the blind bore while the other end bears upon a supporting surface. The blind bore preferably runs parallel to the slit and opens at a side of the pressing member which is opposite that on which the conveyor, especially a belt, is provided. This feature apart from the offset, is known in the art, but in the offset arrangement here described allows the spring, especially the coil spring, to provide an additional guide for the pressing member and nevertheless permits the pressing member to tilt within the limits afforded by the spring since the spring, which is free between the upper edge of the pressing member and the abutment against which it is braced, is freely bendable.

The pin as noted, can be engaged in the slit and can be provided with means for guiding the pressing member parallel to the slit and for retaining the pressing member axially relative to the pin. This means, therefore, can secure the pressing member on the pin so that it is not shiftable axially thereon.

In this manner it can ensure that the pressing member will not slide axially from the holding pin. The means for this purpose can be a coining of the holding pin so as to provide it with a head, a ring which is affixed to the holding pin or a collar on the holding pin which can engage an outer flank of the pressing member or can itself be received in a recess or groove in the pressing member.

In the region of the inclined inlet edge of the pressing member, a roller or other rotary means can be provided to reduce friction between the oncoming conveyor and the pressing member. This can simplify the feeding of a towel or like relatively thick web of material beneath the pressing member in a case in which the belt is deformed by the oncoming edge of the fabric article in the configuration of a sort of step. This step can, thanks to the roller or similar or rotatable member at the inclined edge of the pressing member, pass through the latter without hooking it or locking against the pressing member. As a result, the passage of the article is effected with little generation of noise and without any difficulty.

Preferably the pressing member and the conveyor element, especially the belt, have mutually engaging surfaces which are contoured complementarily so that the conveyor element is guided longitudinally in the travel direction through the pressing member.

This contouring can be a projecting rib on the side of the conveyor opposite that at which the fabric is engaged and which is received in a guide groove of the pressing member within which that rib is engaged.

The rib and groove can be trapezoidal in cross section.

The rib and groove arrangement provide a profiling by means of which the belt is guided by the pressing member. This has been found to highly advantageous for reliable operation of the textile guide system and for its low noise operation.

The invention comprises, therefore, a vertical guide utilizing a pin and slot arrangement for each pressing member which is offset from the center thereof to the upstream end of the pressing member while a spring arrangement acts on the pressing member at a location offset from the center toward the downstream end to avoid flutter and chatter of the pressing member.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
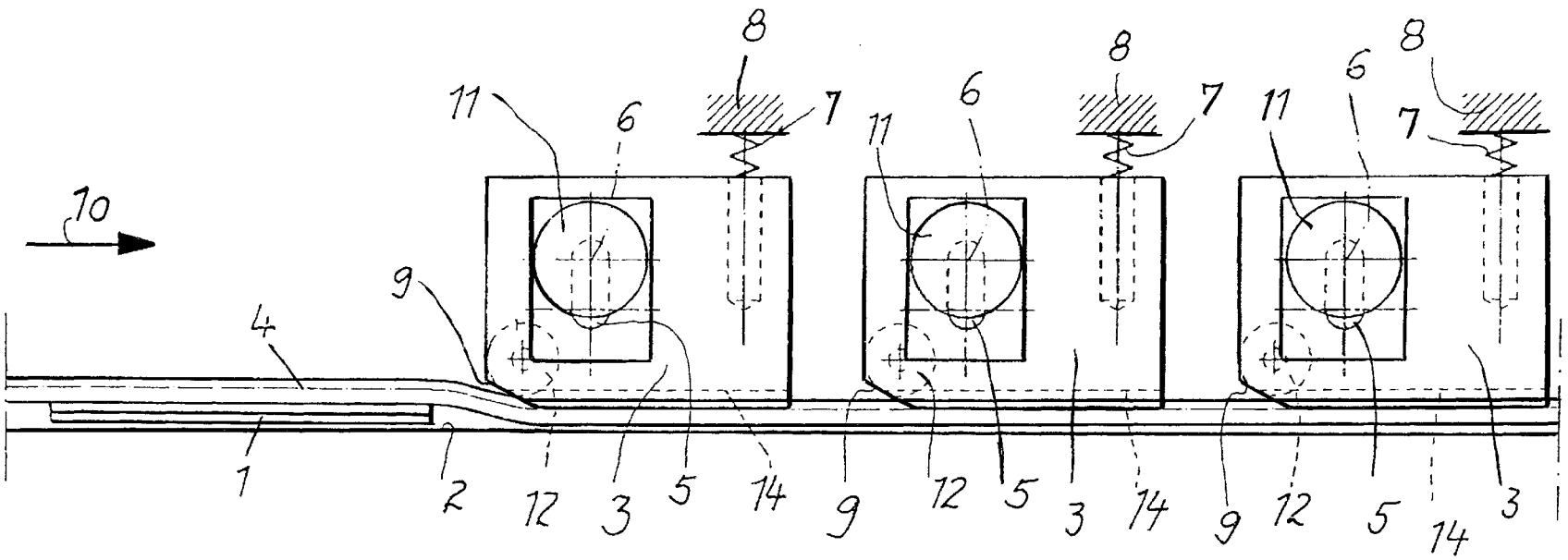
FIG. 1 is a highly diagrammatic side elevational view of the important parts of a textile article feed system according to the invention.
Figure 3:
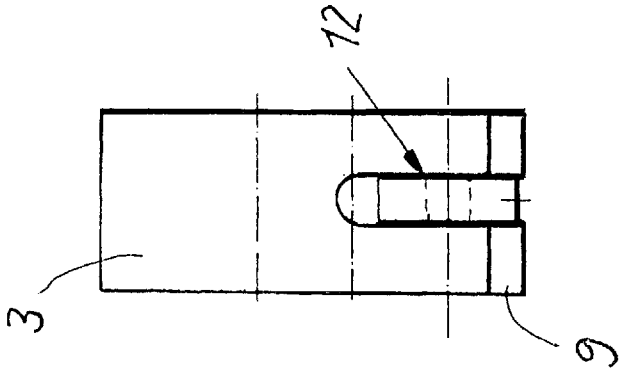
FIG. 3 is an end view thereof showing the upstream end of the pressing member.
Figure 2:
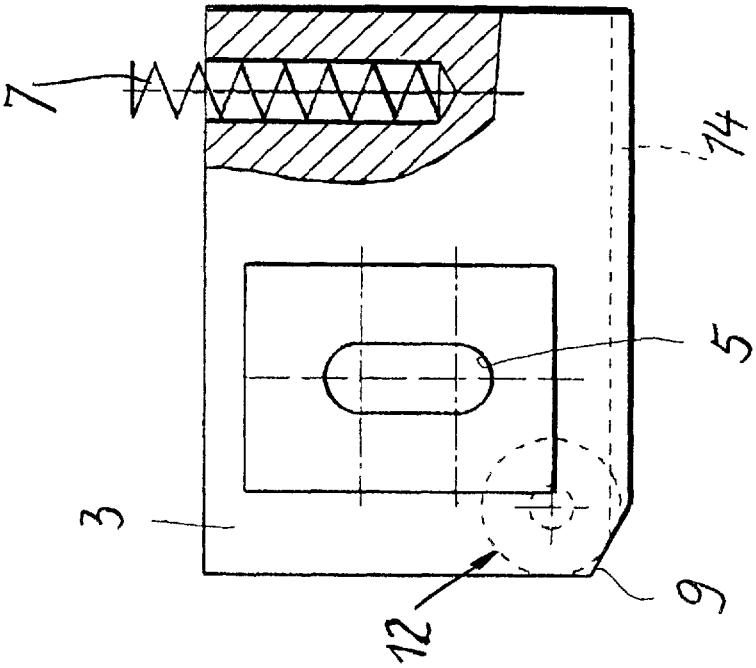
FIG. 2 is an elevational view, partly broken away of a pressing member according to the invention.

In the drawing, a feed system for textile articles, especially for the automatic cutting and sewing of textile webs or like textile processing units has been illustrated.

The textile web 1 or individual textile pieces are preferably guided on their edges by a continuously operating conveyor with, for example, driven belts, to and through processing station, like stations for the folding, seaming or edge fastening or the like. As a result, the textile web 1 or the individual articles are fed between the endless belt and a stationary rail 2 or a stationary set of rollers which are freely rotatable, means being provided for pressing the textile web 1 against the stationary belt 2. The belt 4 which has a planar side engageable with the textile web 1 and on its opposite side is engaged by a plurality of spring-mounted pressing members 3, is formed as a toothed or cog belt and extends into the direction 10 of displacement. The pressing members 3 are spaced apart and oriented in this direction with a gap between them.

Each pressing member 3 is formed with a vertical slot or slit 5 extending perpendicular to the plane of the textile web and, of course, transverse to the direction of displacement 10. Each slit or slot 5 receives a holding pin 6 which in turn is mounted upon a frame or housing structure for the apparatus. the pin 6 serves to guide the member 3 and to limit the excursion thereof in the vertical direction. The slot and the pin 6 are offset from the center of member 3 toward the upstream end of the latter.

Also acting upon the pressing member 3, but at a location close to the downstream end, is a pressing spring 7 which is braced on a portion 8 of the housing such as a stationary bar. The pressing member 3 has at its upstream side a bevel or inclined inlet edge 9 at which the article first approaches the member 3 and with the conveyor belt is pressed toward the support surface 2.

The slot 5 and pin 6, therefore, are located close to the upstream end at which the conveyor belt first approaches the member 3 and close to the front end of the pressing member 3 while the spring 7 is arranged close to the rear end of the pressing member 3.

The pressing member can be provided with a blind bore receiving the pressing spring which can be a coil spring. The blind bore extends parallel to the slot 5 and opens on the side of the pressing member opposite that which engages the belt 4.

The retaining pin 6 engages in the slot 5 and is provided with additional means whereby the pressing member 3 is guided parallel to the slot 5 and which can arrest the pressing member axially relative to the pin 6 so that the pressing member does not shift along this pin. Such means can be represented by a head 11 which can be coined on the pin 6 and engages the pressing member 3 from the exterior. The member 11, for example, suppresses axial movement on the pin 6.

Figure 4:
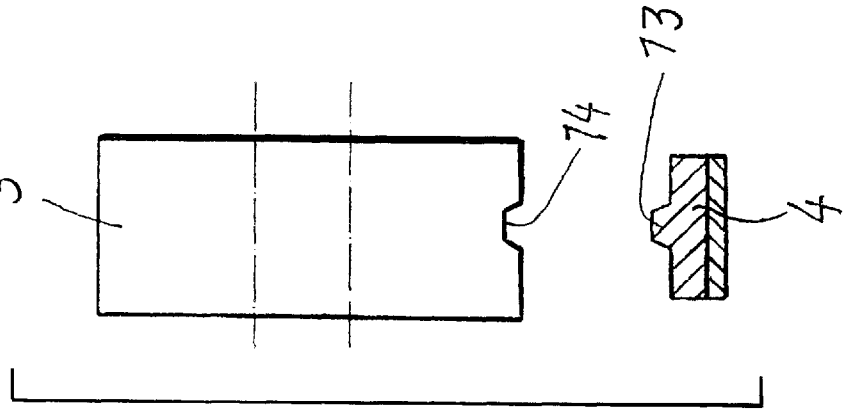
FIG. 4 is a view of the downstream end of the pressing member showing the belt with which it cooperates in cross section.

Preferably the pressing member 3 in the region of the inclined inlet edge 9 has a roller 12 or some other rotary means. As has been made clear from the illustration in FIG. 4, the pressing means 3 at its lower side can have a belt-engaging surface with a contour corresponding to that of the belt, here shown to have a groove 14 of trapezoidal cross section which receives the correspondingly/shaped groove 13. The rib 13 and the groove 14 with their trapezoidal cross section permit a particularly good feed and guidance with the system of the invention.

Upon the approach of a textile article 1 to the first pressing member (see FIG. 1), the orientation of the pin 6 and slot 5 and the spring 7 reduces any tendency of the pressing member 3 to flutter even when a relatively large step is formed in the conveyor 4 as the article 1 approaches the inlet of the pressing member. In addition, a hooking of the belt 4 is avoided by the inclined edge 9 and the roller 12 engaging the conveyor.

Figure 5:
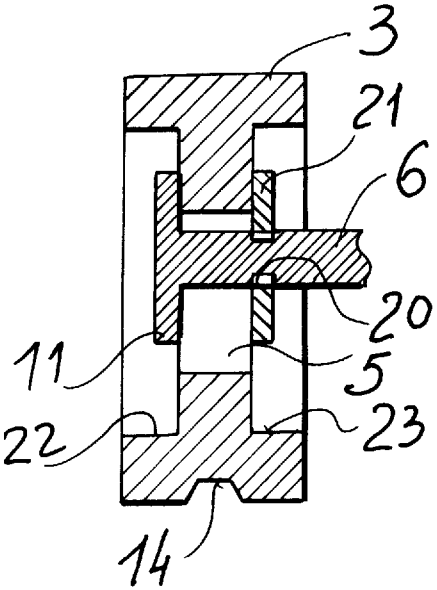
FIG. 5 is a cross sectional view showing the connection between the pin and the pressing member in accordance with an embodiment of the invention.

In FIG. 5 the pressing member is shown to be a body formed with the elongated slot 5 in which the pin 6 is received. The pin is shown to be formed in one piece with the head 11 and to have a groove 20 in which a ring 21 is engaged so that the member 3 is held against axial movement on the pin between the head 11 and the ring 21. Both the head 11 and the ring 21 are received in recesses 22 and 23 formed in the opposite faces of the member 3.

Figure 6:
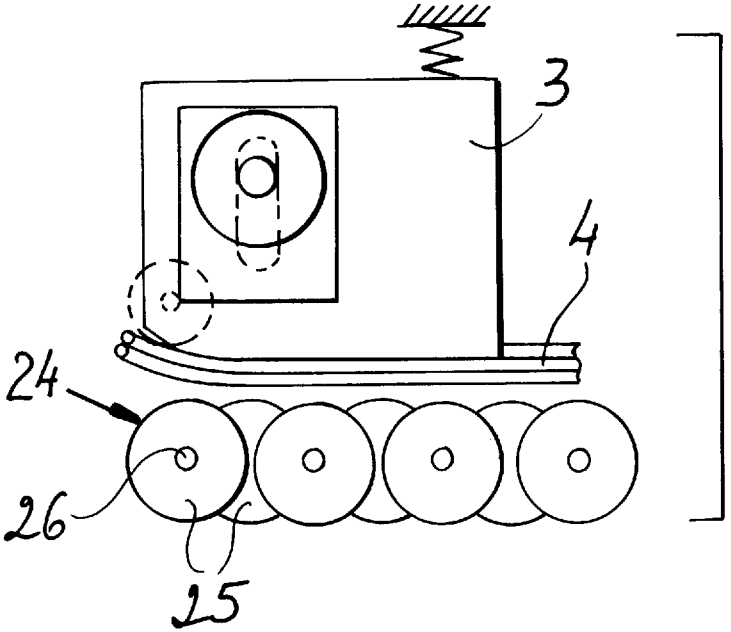
FIG. 6 is a view showing a pressing member located above a support formed by an array of rollers.

FIG. 6 shows that instead of a stationary support 2, the support for the fabric web or pieces 1 thereof can be provided by a bed 24 of rollers 25 rotatable freely on shafts 26 so that, as the conveyor 4 passes over the rollers 25, they are entrained through the fabric which is pressed by the pressing member 3 and the conveyor 4 thereagainst.

Figure 7:
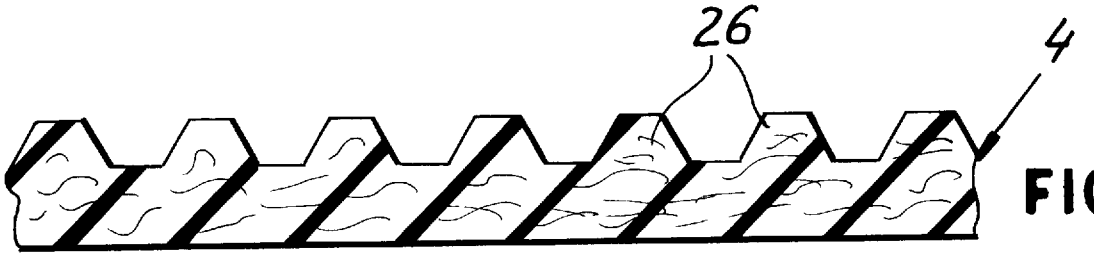
FIG. 7 is a detail view of the conveyor belt showing the toothed nature thereof.

FIG. 7 shows that the belt 4 may be a cog belt, i.e. the rib which is guided in the grooves 14 of the pressing member 3 may be an array of cogs or teeth 26. The belt 4 can be driven by cog wheels not shown.

The invention is not limited to the embodiment shown but can be varied significantly within the framework of the disclosure.

All features which are new and have been described and/or illustrated and individually and in combination, are considered important to the invention.

I claim:

1. A feeder for textile articles comprising:

a support over which textile articles can be fed, a horizontal conveyor displaceable along said support for engaging textile articles between said conveyor and said support for displacing said textile articles along said support; and a plurality of pressing members arrayed horizontally along said support in a direction of displacement of said textile articles therealong for pressing said conveyor against said textile articles and said textile articles against said support, each of said pressing members being formed with:

a body elongated in said direction and having a center midway of a length of the body in said direction, an elongated vertical slot formed in said body at a location spaced from the respective center toward and close to an upstream end thereof, each of said slots being transverse to said direction and said support, a respective fixed guide pin received in each of said slots for guiding the respective pressing member on the respective pin, and respective spring means acting upon each pressing member at a location offset from said center of said body toward a downstream end thereof.

2. The feeder defined in claim 1 wherein said body is formed at an upstream end thereof first approached by said conveyor with an inclined guide surface.

3. The feeder defined in claim 2 wherein said spring means includes a blind bore formed in said body parallel to said slot and opening at a side of said body opposite that at which said body engages said conveyor, and a spring received in said blind bore and projecting therefrom.

4. The feeder defined in claim 3, further comprising means on said pin for retaining said body against axial shifting on said pin.

5. The feeder defined in claim 3, further comprising a roller on said body in the region of said inclined surface for reducing friction between said body and said conveyor.

6. The feeder defined in claim 3 wherein said conveyor is a belt engaging an underside of said body and said belt and said underside for complementary contours guiding said belt laterally relative to said body.

7. The feeder defined in claim 6 wherein said underside is formed with a groove and said belt is formed with a projection shaped complementarily to said groove and guided therein.

8. The feeder defined in claim 7 wherein said projection and said groove are of trapezoidal cross section.

9. The feeder defined in claim 3 wherein said body is formed with a skid surface engaging said conveyor.

10. The feeder defined in claim 9 wherein said body is a generally square block having a lower side formed as a skid surface.

11. The feeder defined in claim 3 wherein said support is a flat surface.

12. The feeder defined in claim 3 wherein said support is an array of rollers.

13. The feeder defined in claim 3 wherein said conveyor comprises at least one belt.

14. The feeder defined in claim 13 wherein said belt is a cogged belt.

* * * * *